US005806024A

United States Patent [19]

Ozawa

[11] Patent Number: 5,806,024

[45] Date of Patent: Sep. 8, 1998

[54] CODING OF A SPEECH OR MUSIC SIGNAL WITH QUANTIZATION OF HARMONICS COMPONENTS SPECIFICALLY AND THEN RESIDUE COMPONENTS

[75] Inventor: Kazunori Ozawa, Tokyo, Japan

[73] Assignee: NEC Corporation, Tokyo, Japan

[21] Appl. No.: 773,523

[22] Filed: Dec. 23, 1996

[30] Foreign Application Priority Data

Dec. 23, 1995 [JP] Japan ..... 7-350138

[51] Int. Cl.[6] ..... G10L 9/00

[52] U.S. Cl. ..... 704/222; 704/223; 704/225; 704/230; 704/239; 704/218; 704/219; 704/221

[58] Field of Search ..... 704/222, 207, 704/223, 225, 204, 206, 230, 239, 218, 219, 221, 216

[56] References Cited

U.S. PATENT DOCUMENTS

| | | | |
|---|---|---|---|
| 4,669,120 | 5/1987 | Ono | 381/40 |
| 4,716,592 | 12/1987 | Ozawa et al. | 704/216 |
| 4,724,535 | 2/1988 | Ono | 704/241 |
| 4,791,670 | 12/1988 | Copperi et al. | 704/222 |
| 4,821,324 | 4/1989 | Ozawa et al. | 704/216 |
| 4,945,565 | 7/1990 | Ozawa et al. | 704/223 |
| 5,027,405 | 6/1991 | Ozawa | 704/223 |
| 5,091,946 | 2/1992 | Ozawa | 704/208 |
| 5,271,089 | 12/1993 | Ozawa | 395/2.31 |
| 5,414,795 | 5/1995 | Tsutsui et al. | 704/204 |
| 5,473,727 | 12/1995 | Nishiguchi et al. | 704/222 |
| 5,598,504 | 1/1997 | Miyano | 704/222 |
| 5,651,090 | 7/1997 | Moriya et al. | 704/222 |
| 5,684,920 | 11/1997 | Iwakami et al. | 704/203 |

OTHER PUBLICATIONS

Moriya et al., "Transform Coding Of Speech Using a Weighted Vector Quantizer", *IEEE Journal on Selected Areas In Communications,* vol. 6(2):425–431, (1988).

Iwakami et al., "High–Quality Audio–Coding At Less Than 64 KBITS/S By Using Transform–Domain Weighted Interleave Vector Quantization", *IEEE Conference Proceedings,* vol. 5:3095–3098, (1995).

Tribolet et al., "Frequency Domain Coding of Speech", *IEEE Transactions on Accoustics, Speech, and Signal Processing,* vol. ASSP–27(5):512–530, (1979).

Kroon et al., "Pitch Predictors With High Temporal Resolution", *IEEE International Conference on Acoustics, Speech, and Signal Processing,* vol. 2:661–664, (1990).

Linde et al., "An Algorithm For Vector Quantizer Design", *IEEE Transactions on Communications,* vol. COM–28(1):84–95, (1980).

Nakamizo, "Signal Analysis And System Identification", pp. 82–87, (1988).

Sugamura et al., "Speech Data Compression By LSP Speech Analysis–Synthesis Technique", *Transactions of the Institute of Electronics and Communication Engineers of Japan,* pp. 599–606, (1981).

*Primary Examiner*—David R. Hudspeth
*Assistant Examiner*—Vijay B. Chawan
*Attorney, Agent, or Firm*—Foley & Lardner

[57] ABSTRACT

Harmonics coefficients are estimated in primary coefficients of an orthogonal transform of a speech or a music input signal by using a pitch frequency extracted from the input signal and are quantized into a harmonics code vector. Residue coefficients are calculated by removing the harmonics coefficients from the primary coefficients and quantized into residue code vectors and gain code vectors. It is possible to search harmonics excitation pulses at the harmonics locations for harmonics quantization into the harmonics code vector. On the other hand, it is possible to estimate the harmonics coefficients or excitation pulses by using quantized LSP parameters and to calculate secondary coefficients for use in weighting the harmonics quantization and residue quantization and, if applicable, in excitation pulse search.

24 Claims, 14 Drawing Sheets

CODING OF A SPEECH OR MUSIC SIGNAL WITH QUANTIZATION OF HARMONICS COMPONENTS SPECIFICALLY AND THEN RESIDUE COMPONENTS

BACKGROUND OF THE INVENTION

This invention relates to a signal encoding method and a signal encoding device for encoding an encoder device input signal, such as a speech or a music signal, into an encoder output signal, at a low bit rate and with a high quality.

An encoder of this type is described in, for example, an article contributed by Takehiro Moriya and another to the IEEE Journal on Selected Area in Communications, Volume 6, No. 2 (Feb. 1988), pages 425 to 431, under the title of "Transform Coding of Speech Using a Weighted Vector Quantizer". Another example is an article contributed by Naoki Iwakami and two others to the IEEE Conference Proceedings for the 1995 International Conference on Acoustics, Speech, and Signal Processing, Volume 5, pages 3095 to 3098, under the title of "High-quality Audio-coding at less than 64 kbits/s by Using Transform-domain Weighted Interleave Vector Quantization (TwinVQ)".

In each of the Moriya et al article and the Iwakami et al article, the device input signal is encoded with a high efficiency on a frequency axis. For this purpose, the discrete cosine transform (DCT) of a multiplicity of points is applied to the device input signal to produce DCT coefficients of an orthogonal transform of the device input signal. The DCT coefficients are segmented at a plurality of segmentation points into coefficient segments. By using a codebook, each coefficient segment is vector-quantized into a code vector.

Incidentally, the DCT is theoretically discussed in detail in a paper contributed by José M. Tribolet and another to the IEEE Transactions on Acoustics, Speech, and Signal Processing, Volume ASSP-27, No. 5 (October 1979), pages 512 to 530, under the title of "Frequency Domain Coding of Speech". For vector quantization, a plurality of sample values (a waveform or spectral envelope) are used as a set. For this one-set vector, a code of one of codebook vectors kept in the codebook is selected that minimizes a distortion. The number given to this selected code is encoded. The vector quantization is used by Kazunori Ozawa, the present inventor, in U.S. Pat. No. 5,271,089, which was assigned to the instant assignee and will be incorporated herein by reference.

According to the Moriya et al and the Iwakami et al articles, a conventional signal encoding device is excellently operable. This is, however, the case when a higher bit rate is used. When the bit rate becomes lower, the conventional signal encoding device gives rise to a deterioration in auditory quality. This mainly depends on the fact that it is impossible with the vector quantization of a smaller number of quantization bits to sufficiently well represent harmonics components of the DCT coefficients.

It may be feasible to improve the vector quantization by increasing the number of the segmentation points. This, however, results in an increase in the number of quantization bits and an exponential increase in the amount of calculation.

SUMMARY OF THE INVENTION

It is consequently an object of the present invention to provide a signal encoding method of encoding a device input signal into a device output signal at a low bit rate and with a high quality.

It is another object of this invention to provide a signal encoding method which is of the type described and by which the device output signal is derived with a small quantity of calculation.

It is still another object of this invention to provide a signal encoding method which is of the type described and by which the device output signal gives an excellent auditory quality even at a low bit rate.

It is yet another object of this invention to provide a signal encoding method which is of the type described and which can excellently encode harmonics components of the device input signal.

It is a further object of this invention to provide a signal encoding device for implementing a signal encoding method of the type described.

Other objects of this invention will become clear as the description proceeds.

In accordance with an aspect of this invention, there is provided a signal encoding method comprising the steps of: (a) calculating an input orthogonal transform of a device input signal to produce input orthogonal transform coefficients of the input orthogonal transform; (b) extracting a pitch frequency from the device input signal; (c) estimating harmonics locations on the input orthogonal transform coefficients by using the pitch frequency to produce harmonics coefficients at the harmonics locations; (d) quantizing the harmonics coefficients collectively as a representative coefficient into a harmonics code vector representative of a quantized representative coefficient; and (e) quantizing residue coefficient of the harmonics coefficients less the quantized representative coefficient into residue code vectors and gain code vectors, whereby the device input signal is encoded into a device output signal comprising a pitch interval of the pitch frequency and indexes indicative of the harmonics code vector, the residue code vectors, and the gain code vectors.

In accordance with another aspect of this invention, there is provided a signal encoding method comprising the steps of: (a) calculating an input orthogonal transform of a device input signal to produce input orthogonal transform coefficients of the input orthogonal transform; (b) extracting a pitch frequency from the device input signal; (c) searching in the device input signal a first pulse sequence of primary excitation pulses by repeatedly using the pitch frequency and a second pulse sequence of secondary excitation pulses without using the pitch frequency; (d) quantizing the excitation pulses of a selected one of the first and the second pulse sequences collectively as a representative pulse into a pulse code vector representative of a quantized representative coefficient; and (e) quantizing residue coefficients of the input orthogonal transform coefficients less the quantized representative coefficient into residue code vectors and gain code vectors, whereby the device input signal is encoded into a device output signal comprising a pitch interval of the pitch frequency and indexes indicative of pulse positions of the primary and the secondary excitation pulses, the pulse code vector, the residue code vectors, and the gain code vectors.

In this aspect of the invention, the excitation pulses are successively searched by using the pitch frequency together with their pulse positions or locations. Such searching is described, for example, in U.S. Pat. No. 4,669,120 issued to Shigeru Ono, assignor to the present assignee and is incorporated herein by reference.

In accordance with still another aspect of this invention, there is provided a signal encoding device comprising: (a) an orthogonal transform circuit responsive to a device input signal for calculating an input orthogonal transform of the device input signal to produce input orthogonal transform coefficients of the input orthogonal transform; (b) a pitch extractor for extracting a pitch frequency from the device input signal; (c) a harmonics estimating circuit responsive to the pitch frequency for estimating harmonics locations on the input orthogonal transform coefficients to produce harmonics coefficients at the harmonics locations; (d) a harmonics quantizer for quantizing the harmonics coefficients collectively as a representative coefficient into a harmonics code vector representative of a quantized representative coefficient; and (e) a residue quantizer for quantizing residue coefficients of the input orthogonal transform coefficients less the quantized representative coefficient into residue code vectors and gain code vectors, whereby the device input signal is encoded into a device output signal comprising a pitch interval of the pitch frequency and indexes indicative of the harmonics code vector, the residue code vectors, and the gain code vectors.

In accordance with yet another aspect of this invention, there is provided a signal encoding device comprising: (a) a spectral parameter quantizing circuit for quantizing spectral parameters of a device input signal into quantized parameters and for converting the quantized parameters into linear prediction coefficients; (b) an inverse filter responsive to the linear prediction coefficients for producing an inverse filtered signal; (c) a first orthogonal transform circuit responsive to the inverse filtered signal for calculating a first orthogonal transform of the device input signal to produce primary coefficients of the first orthogonal transform; (d) a pitch extractor for extracting a pitch frequency from the device input signal; (e) a harmonics estimating circuit responsive to the pitch frequency for estimating harmonics locations on the primary coefficients to produce harmonics coefficients at the harmonics locations; (f) an impulse response calculating circuit for calculating auditorily weighted impulse responses of the linear prediction coefficients to produce an impulse response signal representative of the auditorily weighted impulse responses; (g) a second orthogonal transform circuit responsive to the impulse response signal for calculating a second orthogonal transform of the impulse response signal to produce secondary coefficients of the second orthogonal transform; (h) a harmonics quantizer for quantizing the harmonics coefficients collectively as a representative coefficient by using the secondary coefficients into a harmonics code vector representative of a quantized representative coefficient; and (i) a residue quantizer for quantizing residue coefficients of the primary coefficients less the quantized representative coefficient by using the secondary coefficients into residue code vectors and gain code vectors, whereby the device input signal is encoded into a device output signal comprising indexes indicative of the quantized parameters, the harmonics code vector, the residue code vectors, and the gain code vectors.

In accordance with a different aspect of this invention, there is provided a signal encoding device comprising: (a) an orthogonal transform circuit responsive to a device input signal for calculating an input orthogonal transform of the device input signal to produce input orthogonal transform coefficients of the input orthogonal transform; (b) a pitch extractor for extracting a pitch frequency from the device input signal; (c) a pulse searching circuit for repeatedly searching in the device input signal a first pulse sequence of primary excitation pulses by using the pitch frequency and a second pulse sequence of secondary excitation pulses without using the pitch frequency; (d) a selector for selecting one of the first and the second pulse sequences as a selected sequence of selected excitation pulses that better represents the input orthogonal transform than the other of the first and the second pulse sequences; (e) a harmonics quantizer for quantizing the selected excitation pulses collectively as a representative pulse into a pulse code vector representative of a quantized representative coefficient; and (f) a residue quantizer for quantizing residue coefficients of the input orthogonal transform coefficients less the quantized representative coefficient into residue code vectors and gain code vectors, whereby the device input signal is encoded into a device output signal comprising a pitch interval of the pitch frequency and indexes indicative of pulse positions of the selected excitation pulses, the pulse code vector, the residue code vectors, and the gain code vectors.

In accordance with each of further different aspects of this invention, there is provided a signal encoding device which is of the type set forth above as the different aspect of this invention.

DESCRIPTION OF THE PREFERRED EMBODIMENTS

Figure 1:
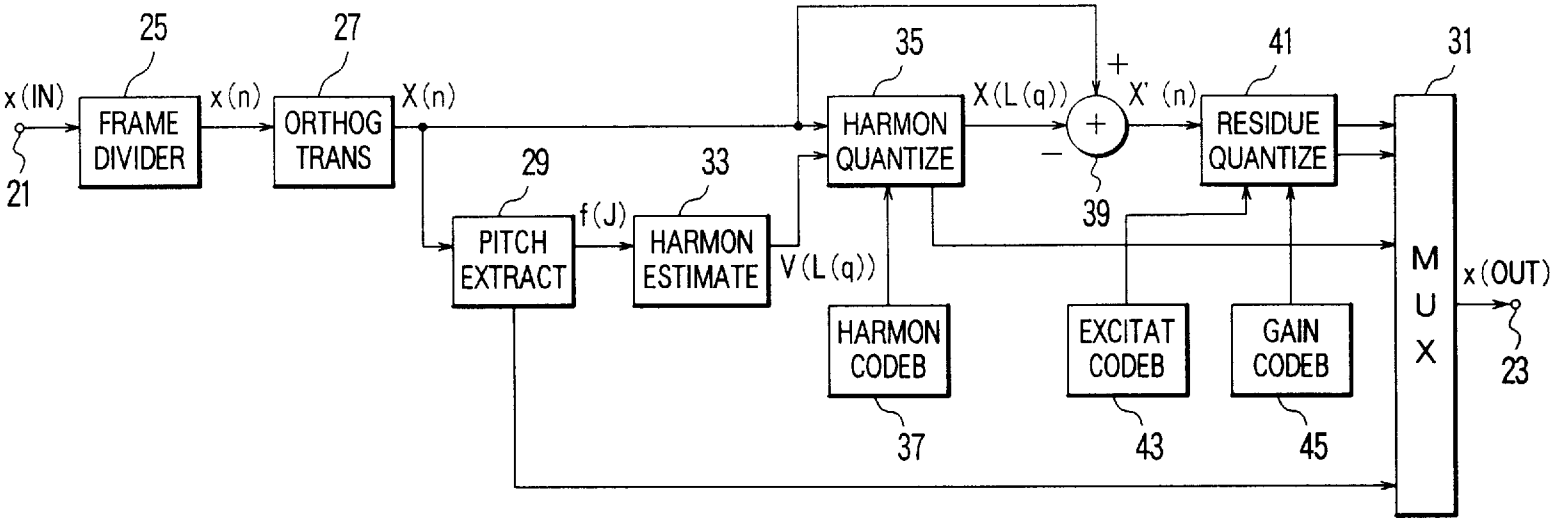
FIG. 1 is a block diagram of a signal encoding device according to a first embodiment of the instant invention.

Referring to FIG. 1, the description will begin with a signal encoding device according to a first embodiment of the present invention. The signal encoding device has an encoder device input terminal 21 supplied with an encoder device input signal x(IN) which is a speech or a music signal. The signal encoding device encodes the device input signal into an encoder device output signal x(OUT) and has an encoder device output terminal 23 through which the device output signal is delivered either to a communication channel or to a recording medium (not shown) for later reproduction.

A frame divider 25 divides the encoder device input signal x(IN) into successive frames, each comprising a predetermined number N of signal samples x(n), where n represents 0, 1, . . . , (N−1). The predetermined number N may be equal to 160. Each frame may afresh be called a device input signal. Responsive to each frame of the device input signal, an orthogonal transform circuit (ORTHOG TRANS) 27 calculates an input orthogonal transform of the device input signal to produce input orthogonal transform coefficients X(n) of the input orthogonal transform. It is preferred to use N-point discrete cosine transform (DCT) as orthogonal transform in the manner described in the Tribolet et al article referred to hereinabove. The input orthogonal transform coefficients will consequently be called input DCT coefficients X(n).

A pitch extractor 29 extracts a pitch frequency from the device input signal x(n). In the example being illustrated, the input DCT coefficients X(n) are delivered to the pitch extractor 29. Subdividing each frame into at least one segment or subframe, each segment consisting of a predetermined integer M of signal samples X(m), where m represents 0, 1, . . . , (M−1), the pitch extractor 29 first calculates a correlation function R(j) in accordance with:

$$R(j) = \sum_{m=0}^{M-1-j} X(m)X(m+j),$$

where j represents a frequency interval between a shorter limit J(1) and a longer limit J(2), both inclusive, in terms of the number of signal samples. The pitch extractor 29 subsequently gives the pitch frequency as f(J), where J represents one of arguments of the correlation function that maximizes R(j)/R(0). It may be mentioned here that the predetermined integer M should be greater than the longer limit J(2) of pitch interval search.

Alternatively, the pitch extractor 29 extracts the pitch frequency f(J) by first calculating a different correlation function R'(j) by:

$$R'(j) = \left[\sum_{m=1}^{M-1} X(m)X(m+j)\right]^2 \div \sum_{m=J(1)}^{M-1} X^2(m-j).$$

Subsequently, the pitch extractor 29 gives the pitch frequency f(J) by the argument which maximizes the different correlation function.

Although the frequency interval j is presumed above as an integral multiple of a sample period of the signal samples X(n) or X(m), it is possible to represent the frequency interval by a noninteger or fractional multiple of the pitch period. If necessary, refer to a paper contributed by Peter Kroon et al to the IEEE ICASSP (International Conference on Acoustics, Speech, and Signal Processing) 90, Volume 2 (April 1990), pages 661 to 664, under the title of "Pitch Predictors with High Temporal Resolution". At any rate, the pitch extractor 29 produces, besides a pitch frequency signal indicative of the pitch frequency f(J), the pitch interval as a pitch frequency index for delivery to a multiplexer 31.

Supplied from the pitch extractor 29 with the pitch frequency signal, a harmonics estimating circuit (HARMON ESTIMATE) 33 estimates first to Q-th harmonics locations L(q) on the input orthogonal transform coefficients X(n) produced by the orthogonal transform circuit 29, where q varies between 1 and Q. The harmonics locations are estimated by substituting the frequency interval j for f(J)/Δ in an equation:

$$L(q)=qf(J)/\Delta, \tag{1}$$

where Δ represents a distance (resolution) between two adjacent ones of the input DCT coefficients X(n) on a frequency axis and is equal to f(s)/N, where in turn f(s) represents a sampling frequency for the signal samples x(n). For example, it will be assumed that the sampling frequency is 16 kHz. In this case, the distance is equal to 50 Hz.

Supplied from the orthogonal transform circuit 27 with the input DCT coefficients X(n), a harmonics quantizer (HARMON QUANTIZE) 35 first locates those of the input DCT coefficients as harmonics coefficients X(L(q)) which are at the harmonics locations L(q). Having located the harmonics coefficients, the harmonics quantizer 35 quantizes at least one of the harmonics coefficients collectively as a representative coefficient into a harmonics code vector by referring to a harmonics amplitude codebook (HARMON CODEB) 37. The harmonics quantizer 35 supplies the multiplexer 31 with a harmonics code vector index indicative of the harmonics code vector. Depending on the circumstances, it is possible to say that the harmonics estimating circuit 33 produces the harmonics coefficients for delivery to the harmonics quantizer 35.

More particularly, it will be surmised that the harmonics quantizer 35 quantizes a prescribed number K of harmonics coefficients as a representative coefficient into the harmonics code vector. The amplitude codebook 37 is for first through K-th harmonics code vectors c[hk] of B bits, where k represents one of 1 to K or $(2^B-1)$. The harmonics quantizer 35 calculates a k-th harmonics distortion D[hk] in accordance with:

$$D[hk] = \sum_{q=1}^{K} [X(L(q)) - \beta c[hk](q)]^2, \tag{2}$$

where β represents an optimum harmonics amplitude gain of a k-th harmonics code vector. The harmonics code vector is one of the first through the K-th harmonics code vectors that minimizes such harmonics distortions. Furthermore, the harmonics quantizer 35 produces a dequantized representative coefficient V(L(q)) by:

$$V(L(q))=\beta c[hk](q).$$

Incidentally, it is possible to use in Equation (2) any other distance measure instead of a square distance measure used therein.

Supplied from the orthogonal transform circuit 27 with the input orthogonal transform coefficients X(n) and from the harmonics quantizer 35 with the dequantized representative coefficient V(L(q)), a subtracter 39 calculates differences as follows to produce residue coefficients X'(n) of the input orthogonal transform coefficients less the quantized representative coefficient. The differences are calculated according to:

$$X'(n)=X(n) \text{ if } n\neq L(q)$$

$$X'(n)=X(L(q))-V(L(q)) \text{ if } n=L(q).$$

A residue quantizer 41 quantizes the residue coefficients X'(n) first into residue or excitation source code vectors c[rk](n) with reference to an excitation source codebook (EXCITAT CODEB) 43 and then into gain code vectors γ[k] with reference to a gain codebook 45 and supplies the multiplexer 31 with residue code vector indexes indicative of the residue code vectors and gain code vector indexes indicative of the gain code vectors. The excitation source codebook 43 is searched for a k-th residue code vector so as to minimize a k-th residue distortion D[rk] given by:

$$D[rk] = \sum_{n=0}^{N-1} [X'(n) - \gamma[k]c[rk](n)]^2$$

when the square distance measure is used. For each of the residue code vectors c[rk](n), the gain codebook 45 is searched to minimize a k-th gain code vector distortion D[r'k] given by:

$$D[r'k] = \sum_{N=0}^{N-1} [X(n) - \beta[k]c[hk](q) - \gamma[k]c[rk](n)]^2,$$

where a combination (β[k], γ[k]) represents a k-th element of a two-dimensional gain code vector stored in the gain codebook 45.

Preferably, the excitation source and the gain codebooks 43 and 45 are preliminarily trained by using a multiplicity of training signals. If necessary, the manner of training should be referred to a paper contributed by Yoseph Linde and two others to the IEEE Transactions on Communications, Volume COM-28, No. 1 (January 1980), pages 84 to 95, under the title of "An Algorithm for Vector Quantizer Design".

It is now understood that the multiplexer 31 delivers the decoder output signal x(OUT) to the device output terminal 23. In the decoder output signal, multiplexed are the indexes indicative of the pitch frequency, the harmonics code vector, the residue code vectors, and the gain code vectors. It is possible to make the harmonic quantizer 35 quantize polarities sign(X(L(q))) of the harmonics coefficients.

Figure 2:
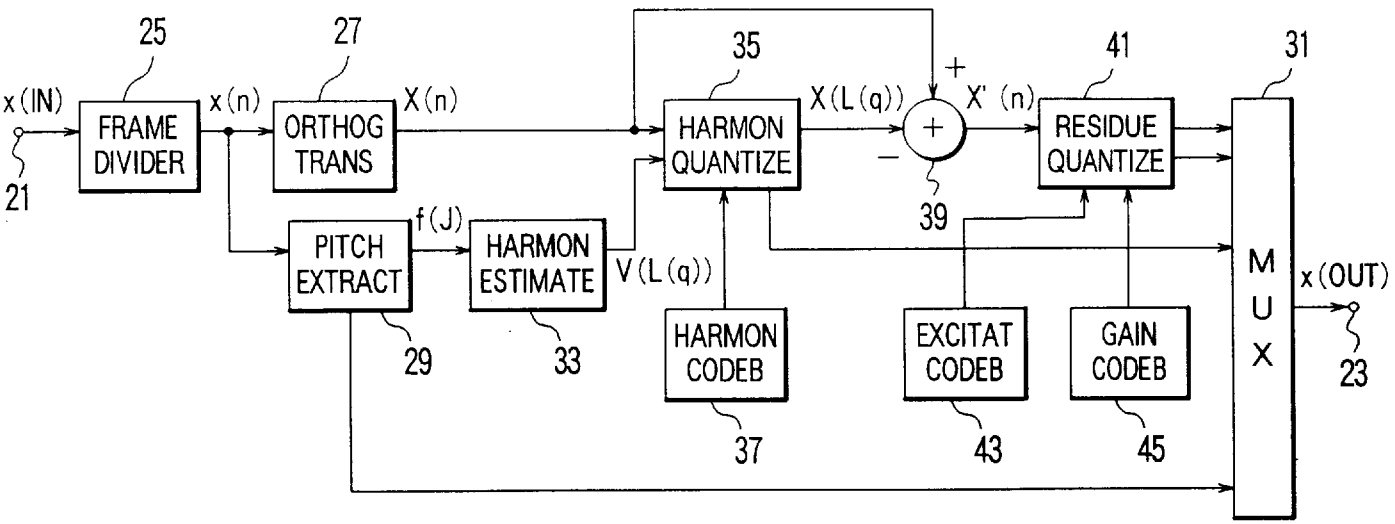
FIG. 2 is a block diagram of a signal encoding device according to a second embodiment of this invention.

Referring to FIG. 2, the description will proceed to a signal encoding device according to a second embodiment of this invention. It should be noted throughout the following that similar parts are designated by like reference numerals and are similarly operable with likewise named signals and quantities.

In FIG. 2, the pitch extractor 29 is supplied directly from the frame divider 25 with the signal samples n(x). The pitch extractor 29 extracts the pitch frequency f(J) like that described in conjunction with FIG. 1. The pitch extractor 29 first calculates a correlation function R(j) which is now:

$$R(j) = \sum_{n=0}^{M-1-j} x(n)x(n+j), \quad (3)$$

which is maximized when the frequency interval j is equal to a pitch period T.

Alternatively, it is possible to use another correlation function R'(j) given by:

$$R'(j) = \left[ \sum_{n=J(1)}^{M-1} x(n)x(n-j) \right]^2 \div \sum_{n=J(1)}^{M-1} x^2(n-j).$$

The pitch frequency f(J) is given by:

$$f(J)=f(s)/T. \quad (5)$$

Figure 3:
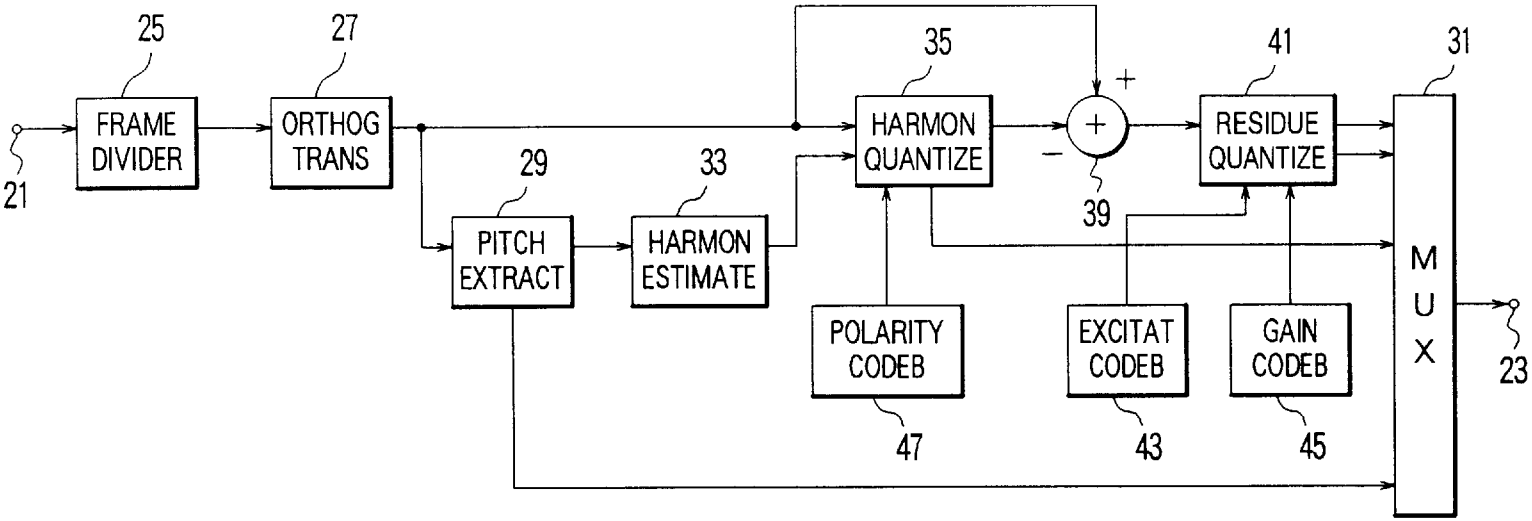
FIG. 3 is a block diagram of a signal encoding device according to a third embodiment of this invention.

Referring to FIG. 3, the description will further proceed to a signal encoding device according to a third embodiment of this invention. In FIG. 3, the harmonics quantizer 35 quantizes polarities sign(X(q)) of the harmonics coefficients collectively as a polarity of the representative coefficient, rather than amplitudes of the harmonics coefficients, into the harmonics code vector with reference to a harmonics polarity codebook 47.

First through K-th or $(2^B-1)$-th polarity code vectors p[k](q) are preliminarily stored in the harmonics polarity codebook 47. Responsive to the polarity of the representative coefficient, the harmonics quantizer 35 searches one of the polarity code vectors as the harmonics code vector that minimizes a k-th gain code vector distortion D[k] given by:

$$D[k] = \sum_{q=1}^{K} [X(L(q)) - \beta p[k](q)]^2.$$

Figure 4:
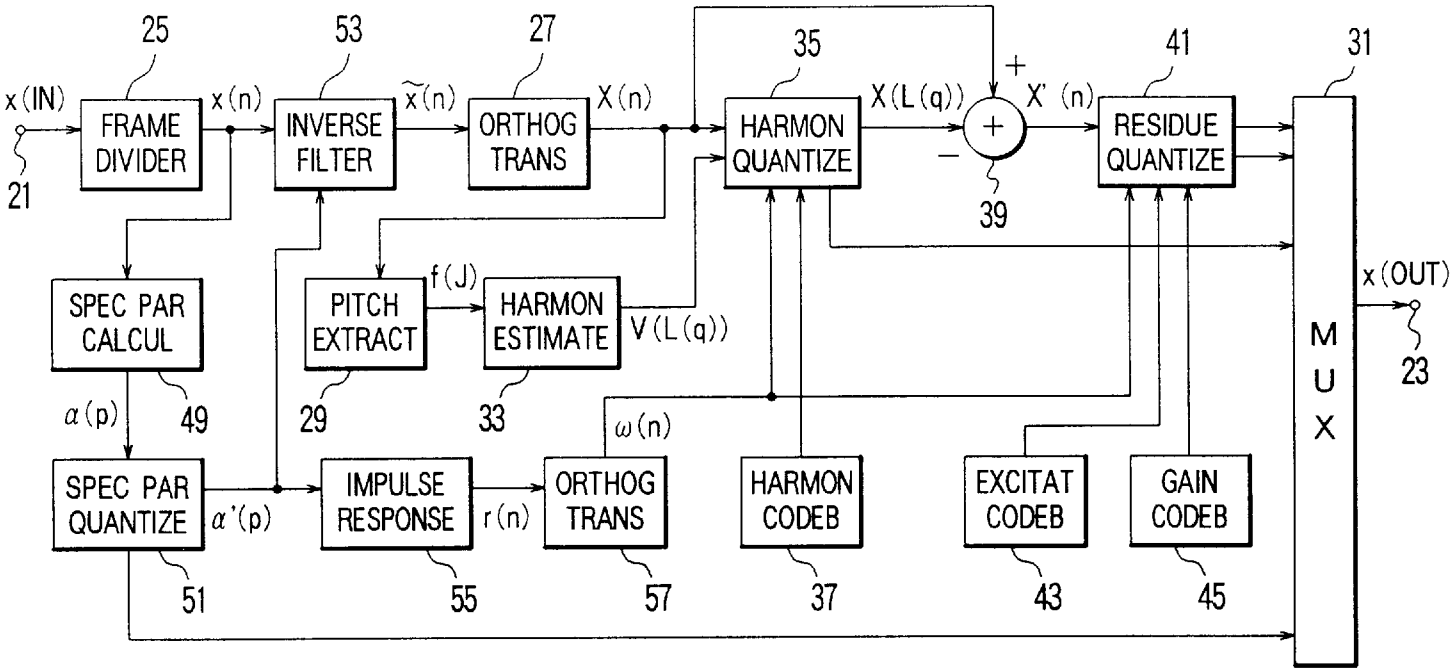
FIG. 4 is a block diagram of a signal encoding device according to a fourth embodiment of this invention.

Referring now to FIG. 4, attention will be directed to a signal encoding device according to a fourth embodiment of this invention. Although designated by the reference numerals 35 and 41 as before, the harmonic quantizer 35 and the residue quantizer 41 are operable in a manner which is somewhat different from those described in connection with FIGS. 1 and 3. Their output signals will nevertheless be called as above. The orthogonal transform circuit 27 is now referred to as a first orthogonal transform circuit 27 with the input orthogonal transform called a first orthogonal transform and with the input orthogonal transform coefficient called primary coefficients.

Supplied from the frame divider 25 with the signal samples x(n) of successive frames, a spectral parameter calculator (SPEC PAR CALCUL) 49 calculates first through P-th linear prediction coefficients (LPC) α (p) as a prescribed number, such as ten, of spectral parameters, where p represents 1, 2, . . . , P. It is possible to calculate such spectral parameters by the known LPC analysis or the Burg analysis which is described in a book written by Nakamizo and published 1988 by Korona-Sya under the title of, as transliterated according to ISO 3602, "Singô Kaiseki to Sisutemu Dôtei" (Signal Analysis and System Identification), pages 82 to 87. Furthermore, the spectral parameter calculator 49 converts the linear prediction coefficients into line spectrum pair (LSP) parameters LSP(p) which are convenient in quantization and interpolation and are described in a paper contributed by Sugamura and another to the Transactions of the Institute of Electronics and Communication Engineers of Japan, J64-A (1981), pages 599 to 606, under the title of "Sen-supekutoru Tai Onsei Bunseki Gôsei Hôsiki ni yoru Onsei Zyôho Assyuku (Speech Data Compression by LSP Speech Analysis-Synthesis Technique)".

Connected to the spectral parameter calculator 49, a spectral parameter quantizer circuit (SPEC PAR QUANTIZE) 51 first quantizes the LSP parameters LSP(p) into quantized parameters QLSP(p) to produce quantized parameter indexes indicative of the quantized parameters for delivery to the multiplexer 31. Subsequently, the spectral quantizer 51 converts the quantized parameters to first to P-th dequantized LPC's α '(p) for production separately of the quantized parameter indexes.

It is possible to quantize the LSP parameters into the quantized parameters in accordance with vector quantization described in U.S. Pat. No. 5,271,089 referred to hereinabove. More in detail, the parameter quantizer 51 minimizes for decision of an index indicative of a j-th quantized parameter $QLSP(p)_j$ a j-th parameter distortion Dj given by:

$$D_j = \sum_{p=1}^{P} B(p)\,[LSP(p) - QLSP\,(p)_j]^2,$$

where j represents a j-th index although the lower-case letter j is used in common to the pitch interval, B(p) representing a p-th weighting factor described in the United States patent.

Connected to the frame divider 25 and to the parameter quantizer 51, an inverse filter 53 produces an inverse filtered signal $\tilde{x}$ (n) which corresponds to the first through the N-th signal sample of each frame. On the other hand, an impulse response calculating circuit 55 is supplied with the dequantized LPC's α '(p) to produce first to N-th auditorily or perceptually weighted impulse responses h(i) in which n is rewritten into a different lower-case letter i and which represent at first to N-th points an auditorily weighted filter having a transfer function W(z) given by a z-transform by:

$$W(z) = 1/\sum_{p=1}^{P} \alpha'(p)\,\eta^p z^{-p},$$

where η represents an auditorily weighting coefficient and is between 0 and 1.0, both inclusive. The impulse response calculating circuit 55 furthermore calculates autocorrelation coefficients for production of an impulse response signal representative of first through N-th impulse response correlation functions r(n) given by:

$$r(n) = \sum_{i=0}^{N-1-n} h(i)h(i+n).$$

Connected to the impulse response calculating circuit 55, a second orthogonal transform circuit 57 deals with N-point DCT transform of the impulse response signal into a second orthogonal transform to produce first to N-th secondary coefficients which are delivered to the harmonics quantizer 35 and to the residue quantizer 41. In each of the harmonics and the residue quantizers 35 and 41, the secondary orthogonal coefficients are used as first through N-th weighting coefficients ω (n).

As a consequence, the harmonics quantizer 35 searches the harmonics amplitude codebook 37 to minimize a k-th weighted harmonics distortion D'[hk] given by:

$$D'[hk] = \sum_{q=1}^{K} \omega(L(q))\,[X(L(q)) - \beta c[hk](q)]^2.$$

The residue quantizer 41 searches the excitation source codebook 43 to minimize a k-th weighted residue distortion D'[rk] given by:

$$D'[rk] = \sum_{n=1}^{N-1} \omega(n)\,[X'(n) - \gamma[k]c[rk](n)]^2.$$

The residue quantizer 41 furthermore searches the gain codebook 47 to minimize a k-th weighted gain code vector distortion D'[r'k] given by:

$$D'[r'k] = \sum_{n=0}^{N-1} [X(n) - \beta[k]c[hk](q) - \gamma[k]c[rk](n)]^2.$$

In the signal encoding device comprising the parameter quantizer 51, it is unnecessary for the pitch extractor 29 to produce the pitch interval for inclusion in the device output signal. The device output signal therefore comprises indexes indicative of the quantized parameters, the harmonic code vector, the residue code vectors, and the gain code vectors.

Figure 5:
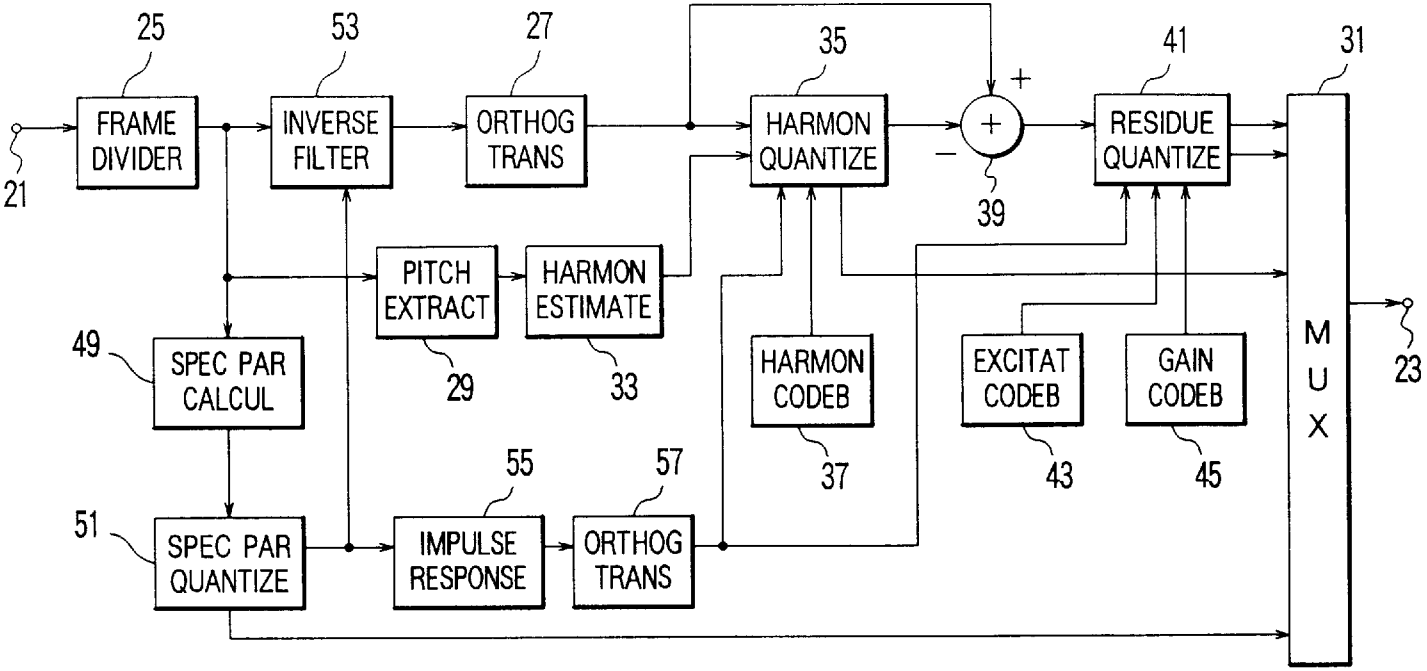
FIG. 5 is a block diagram of a signal encoding device according to a fifth embodiment of this invention.

Referring to FIG. 5, the description will proceed to a signal encoding device according to a fifth embodiment of this invention. Like in FIG. 2, the pitch extractor 29 is supplied from the frame divider 25 with the signal samples of the successive frames. In other respects, the signal encoding device is identical with that illustrated with reference to FIG. 4.

Figure 6:
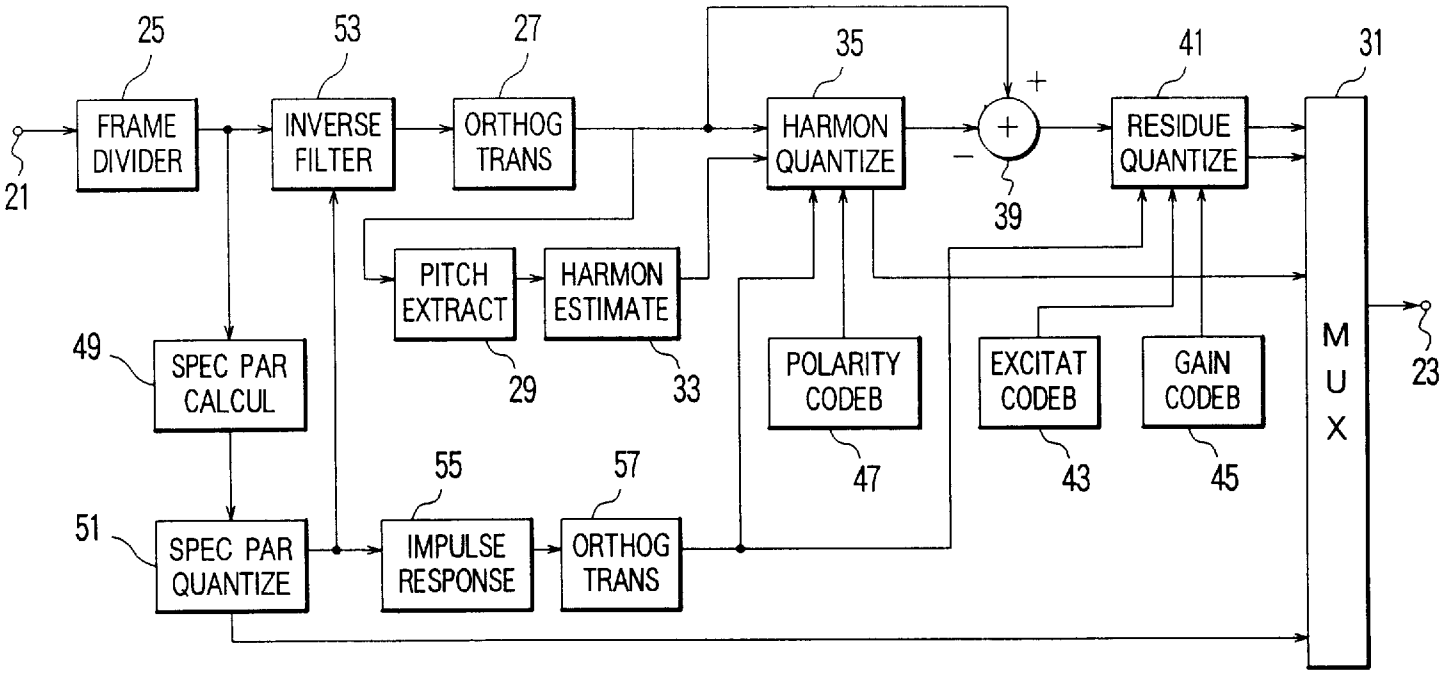
FIG. 6 is a block diagram of a signal encoding device according to a sixth embodiment of this invention.

Referring to FIG. 6, the description will proceed to a signal encoding device according to a sixth embodiment of this invention. As in FIG. 3, the harmonics quantizer 35 refers to the harmonics polarity codebook 47 to quantize a polarity of the representative coefficient into a k-th one of the first through the K-th or the $(2^B-1)$-th polarity code vectors p[k](q) that minimizes a k-th weighted harmonics distortion D'[hk]. The harmonics quantizer 35, however, uses in this instance those of the first through the N-th weighting coefficients which correspond to first through K-th harmonics coefficients L(q).

Like for the harmonics amplitude codebook 37 described in conjunction with FIG. 4, the k-th weighted harmonics distortion is given by:

$$D'[hk\} = \sum_{q=1}^{K} \omega(L(q))\,[X(L(q)) - \beta p[k](q)]^2.$$

The subtractor 39 produces the residue coefficients X'(n) as in FIG. 3 or 4. The residue quantizer 41 is therefore operable as before.

Figure 7:
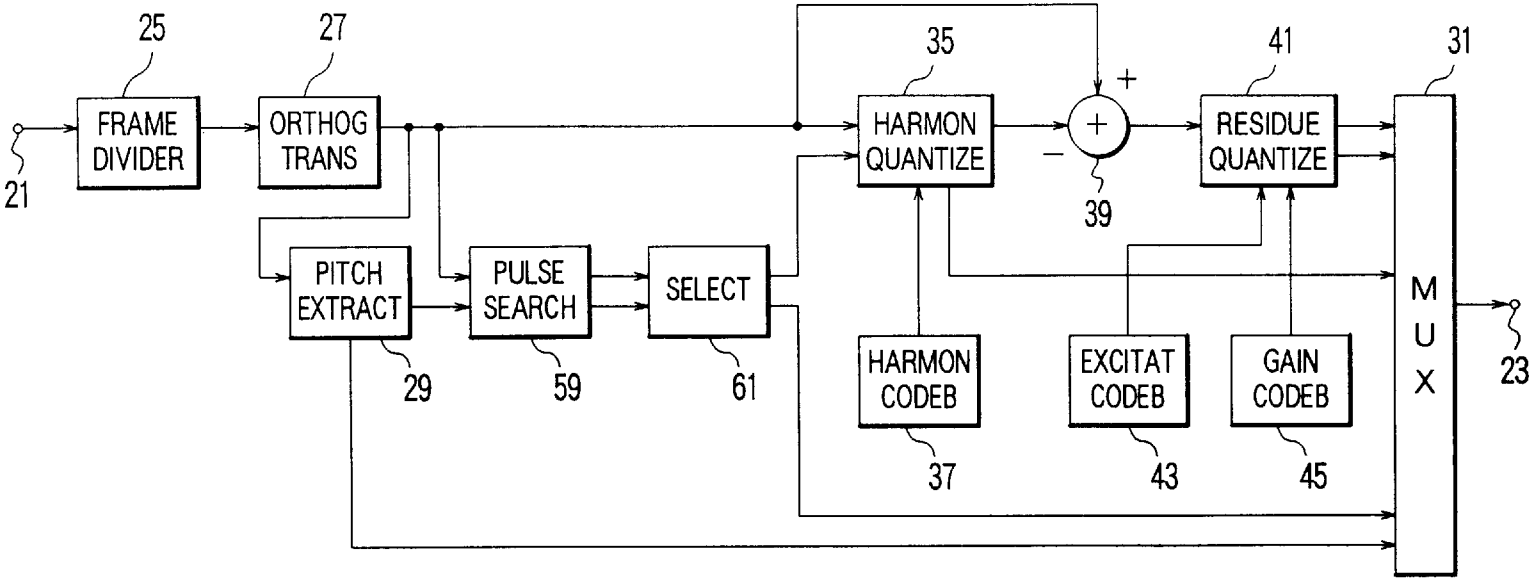
FIG. 7 is a block diagram of a signal encoding device according to a seventh embodiment of this invention.

Referring now to FIG. 7, attention will be directed to a signal encoding device according to a seventh embodiment of this invention. In examples which are and will henceforth be described, use is not made of the harmonics coefficients but of excitation pulses like in U.S. Pat. No. 4,669,120 cited hereto before.

As in FIGS. 1 to 3, the first orthogonal transform circuit 27 is connected directly to the frame divider 25 to produce the primary coefficients X(n) of the first orthogonal transform of each frame x(n) of the device input signal x(IN). Like in FIGS. 1 and 3, the pitch extractor 29 extracts the pitch frequency f(J) from the primary coefficients produced in connection with the successive frames of the device input signal.

Connected to the first orthogonal transform circuit 27 and to the pitch extractor 29, a pulse searching circuit 59 searches in the primary coefficients a first pulse sequence of first to K-th primary excitation pulses d[pr](k) in a pulse search interval which may be coincident either with each frame or with each segment and is M signal samples long, where K now represents a prescribed integer. On searching the primary excitation pulses, the pulse searching circuit 59 first estimates the first to the Q-th harmonics locations L(q) by using the pitch frequency f(J). Subsequently, the pulse searching circuit 59 repeatedly searches the primary excitation pulses having primary excitation pulse amplitudes a[pr](k) at primary excitation pulse positions or locations m[pr](k) which are positioned at certain ones of the first to the Q-th harmonics locations. The primary excitation pulses are specified by the excitation pulse positions and the excitation pulse amplitudes. The excitation pulse positions are searched to minimize a primary excitation pulse distortion D[pr] given by:

$$D[pr] = \sum_{n=0}^{M-1} \left[ X(n) - \sum_{k=1}^{K} a[pr](k) \times \delta(n - m[pr](k) - L(q)) \right]^2, \quad (5)$$

where δ indicates the Kroneckers's delta.

The excitation pulse searching circuit 59 furthermore searches for a second pulse sequence of first to K-th secondary excitation pulses d[sec](k) without using the pitch frequency but only the primary coefficients X(n). The secondary excitation pulses have secondary excitation pulse amplitudes a[sec](k) at secondary excitation pulse positions m[sec](k). The secondary excitation pulse positions are searched so as to minimize a secondary excitation pulse distortion D[sec] given by:

$$D[\text{sec}] = \sum_{n=0}^{M-1} \left[ X(n) - \sum_{K=1}^{K} a[\text{sec}](k) \times \delta(n - m[\text{sec}](k)) \right]^2. \quad (6)$$

In Equations (5) and (6), the square distance measure are used as in Equation (2).

It is possible to search the primary and the secondary excitation pulses with the prescribed integer K prescribed in the pulse search interval M to preliminarily select candidate pulse locations at the signal samples given in the following table for the pulse search interval of forty signal samples and the prescribed integer of five.

0, 5, 10, 15, 20, 25, 30, 35,
1, 6, 11, 16, 21, 26, 31, 36,
2, 7, 12, 17, 22, 27, 32, 37,
3, 8, 13, 18, 23, 28, 33, 38,
4, 9, 14, 19, 24, 29, 34, 39.

In this event, the excitation pulse positions m[pr](k) or m[sec](k) are represented by three bits. Five pulses are represented by fifteen bits. That is, each row (eight elements) of the table are represented by the three bits to indicate the excitation pulse positions. The fifteen bits can indicate the five pulses in some or other of five rows of the table. It is possible in this manner to do with a small number of bits.

Supplied from the pulse searching circuit 59 with the primary and the secondary pulse amplitudes, positions, and distortions, a pulse sequence selector 61 selects one of the first and the second pulse sequences as a selected sequence d(k) that has a smaller one of the primary and the secondary excitation pulse distortions, namely, that better represents the harmonics coefficients than the other of the first and the second pulse sequences. The pulse sequence selector 61 thereupon produces the excitation pulse amplitudes and positions of the selected sequence and supplies the multiplexer 31 with an index indicative of the excitation pulse positions of the selected sequence.

Responsive to the excitation pulse amplitudes and positions of the selected sequence, a harmonics pulse amplitude quantizer is operable as the harmonics quantizer 35 to quantize the excitation pulse amplitudes of the selected sequence with reference to a pulse amplitude codebook operable as the harmonics amplitude codebook 37. In the harmonics quantizer 35 , the excitation pulse amplitudes of the selected sequence serve in cooperation with their excitation pulse positions as the representative coefficient.

The harmonics quantizer 35 now quantizes the representative coefficient into a quantized harmonics amplitude to produce the dequantized representative coefficient of a harmonics code vector c[hk](q) and to supply the multiplexer 31 with the index indicative of the harmonics code vector. The harmonics code vector is searched in the harmonics amplitude codebook 37 to minimize a k-th harmonics distortion D[hk] given by:

$$D[hk] = \sum_{q=1}^{K} [X(m(q)) - \beta c[hk](q)]^2,$$

where m(q) represents a q-th excitation pulse position.

Similar to those described in connection with FIG. 1, the subtracter 39 produces the residue coefficients. The residue quantizer 41 refers to the excitation pulse codebok 43 and the gain codebook 45 to deliver the indexes indicative of the residue code vectors and the gain code vectors to the multiplexer 31, which feeds the device output terminal 23 with the device output signal comprising the pitch interval and the indexes indicative of the excitation pulse positions of the selected excitation pulses, the harmonics or pulse code vector, the residue code vectors, and the gain code vectors.

Figure 8:
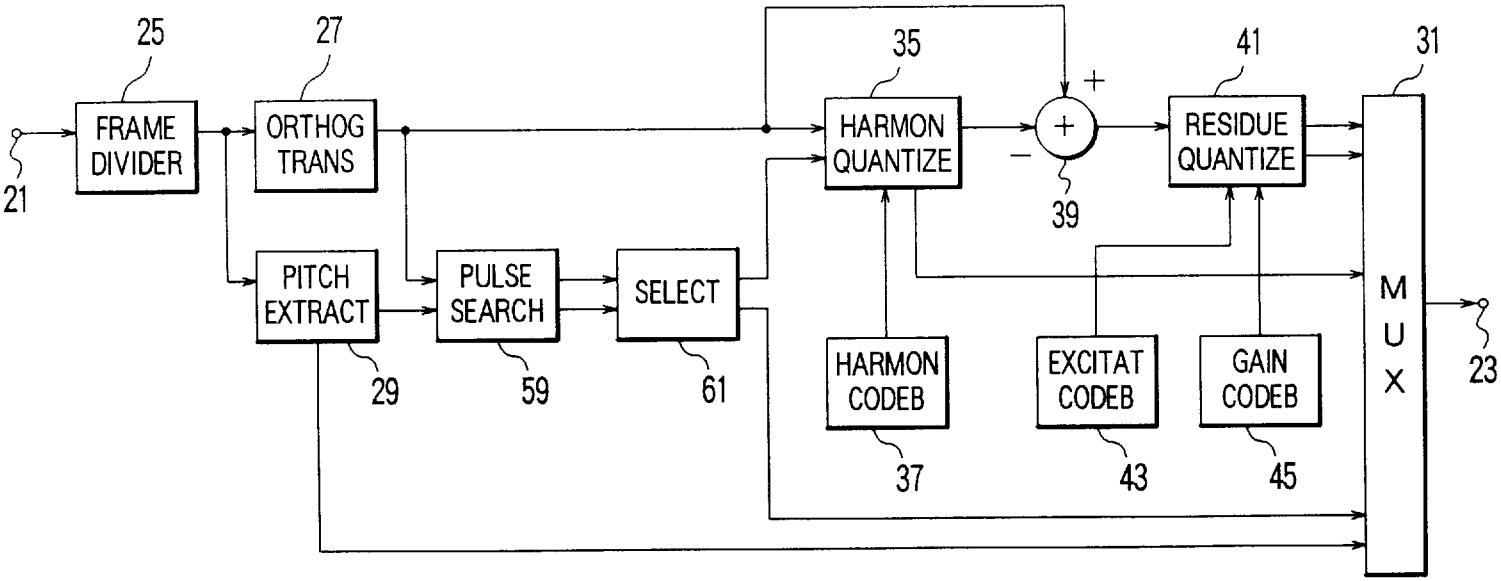
FIG. 8 is a block diagram of a signal encoding device according to an eighth embodiment of this invention.

Referring to FIG. 8, the description will proceed to a signal encoding device according to an eighth embodiment of this invention. This signal encoding device is similar to that illustrated with reference to FIG. 7 except that the pitch extractor 29 is supplied with the successive frames of the device input signal like in FIG. 2.

Figure 9:
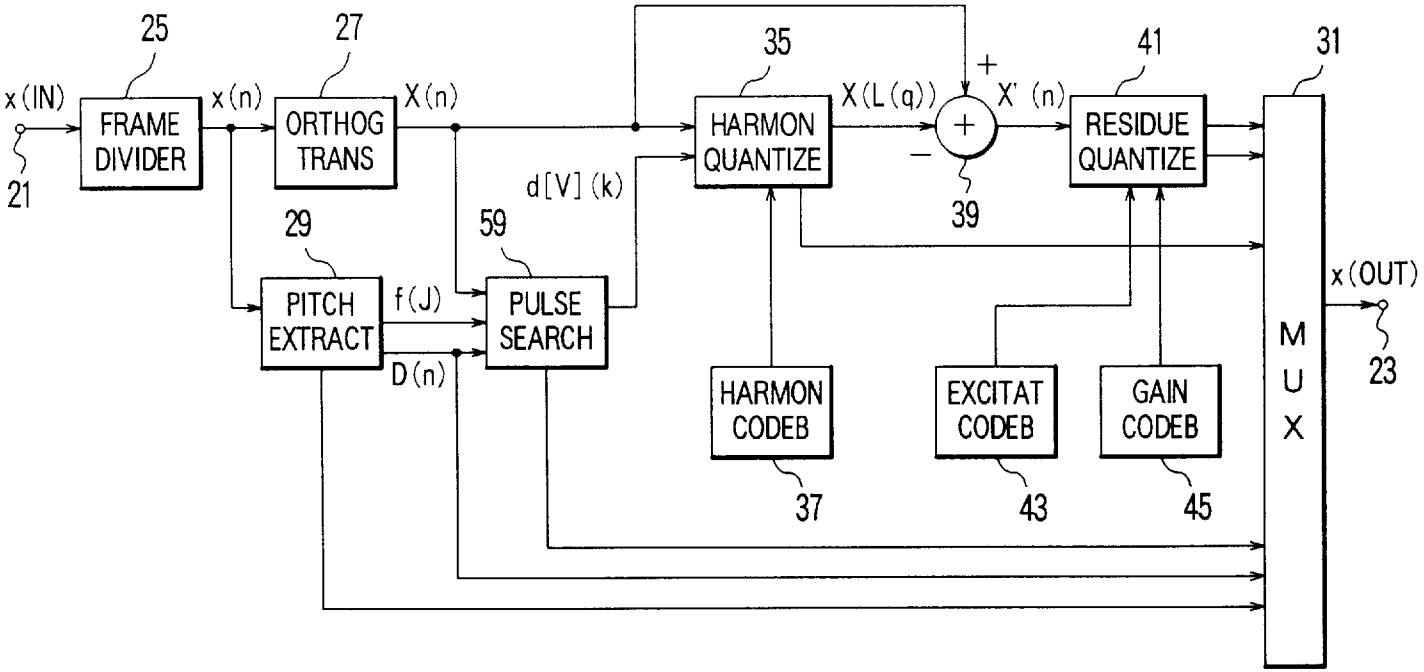
FIG. 9 is a block diagram of a signal encoding device according to a ninth embodiment of this invention.

Referring to FIG. 9, the description will proceed further to a signal encoding device according to a ninth embodiment of this invention. This signal encoding device is similar to that described with reference to FIG. 8 insofar as the frame divider 25, the first orthogonal transform circuit 27, and input to the pitch extractor 29 are concerned.

In FIG. 9, the pitch extractor 29 is somewhat differently operable. More particularly, the pitch extractor 29 extracts the pitch frequency f(J) like in FIGS. 1 to 8 and discriminates the successive frames x(n) of the device input signal x(IN) between a voiced and an unvoiced frame, namely, whether each frame is the voiced or the unvoiced frame. The pitch extractor 29 thereby produces the pitch frequency and discrimination information D(n) indicative of one of the voiced and the unvoiced frames in connection with each of the successive frames and supplies the multiplexer 31 with the discrimination information.

In order to discriminate between the voiced and the unvoiced frames, the pitch extractor 29 may compare a pitch gain G(n) of each frame with a predetermined threshold gain to decide the frame in question as the voiced and the unvoiced frames when the pitch gain exceeds and does not exceed the threshold gain, respectively. The pitch gain is given by:

$$G(n)=R(0)/[R(0)-R(T)].$$

In FIG. 9, the pulse searching circuit 59 is supplied from the first orthogonal transform circuit 27 with the primary coefficients X(n) and from the pitch extractor 29 with the pitch frequency and the discrimination information to serve somewhat like a combination of the pulse searching circuit 59 and the pulse sequence selector 61 which are described above most in detail with reference to FIG. 5. More specifically, the pulse searching circuit (59, 61) uses the discrimination information in discriminating the primary coefficients between those of the voiced and the unvoiced frames and repeatedly searches in each voiced frame a voiced frame pulse sequence of first to K-th primary excitation pulses d[V](k) by using the pitch frequency and in each unvoiced frame an unvoiced frame pulse sequence of first to K-th secondary excitation pulses without using the pitch frequency by using Equations (5) and (6). Amplitudes of the primary excitation pulses correspond in cooperation with their primary excitation pulse positions to the harmonics coefficients. The pulse searching circuit 59 supplies consequently the primary excitation pulses to the harmonics quantizer 35. In addition, the pulse searching circuit 59 supplies the multiplexer 31 with an index indicative of the primary and the secondary excitation pulse positions.

In other remaining respects, the signal encoding device of FIG. 9 is similar to that illustrated with reference to FIG. 8. It should, however, be noted in connection with the remaining respects that the device output signal comprises the pitch interval, the discrimination information, and indexes indicative of pulse positions of the primary and the secondary excitation pulses, the harmonics code vector, the residue code vectors, and the gain code vectors.

Figure 10:
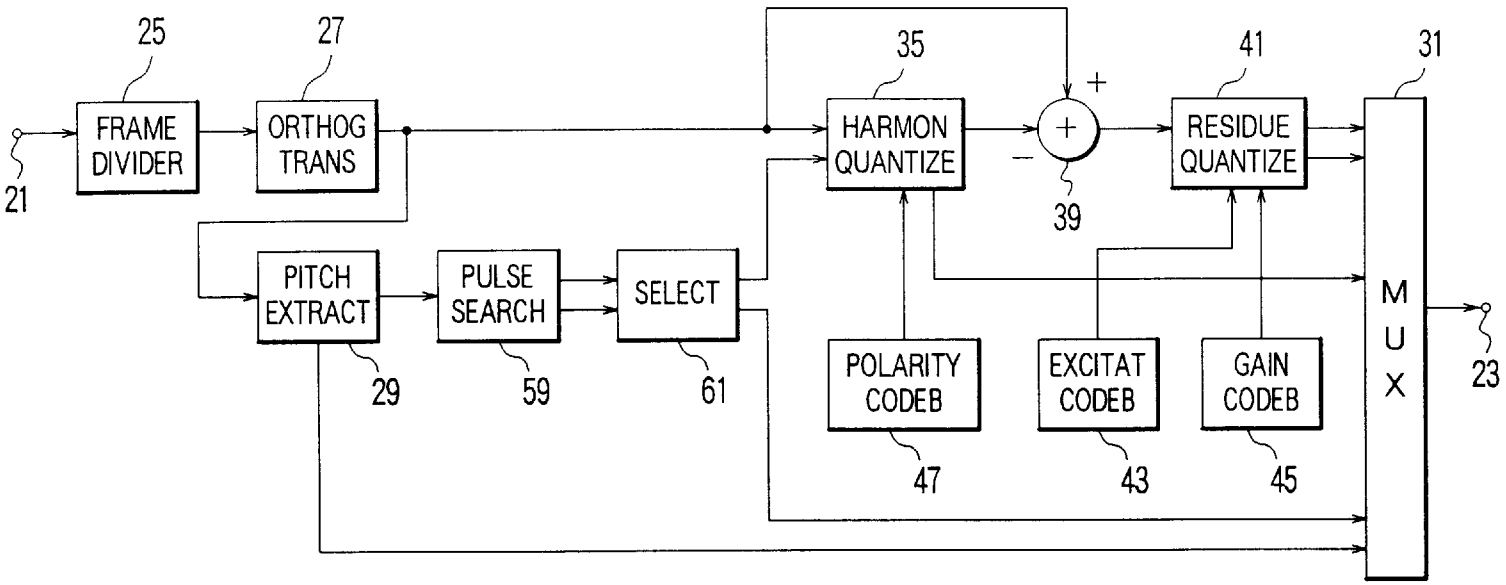
FIG. 10 is a block diagram of a signal encoding device according to a tenth embodiment of this invention.

Referring to FIG. 10, the description will still further proceed to a signal encoding device according to a tenth embodiment of this invention. In FIG. 10, the harmonics quantizer 35 is a pulse polarity quantizer of the type described in conjunction with FIG. 6 and refers to the harmonics polarity codebook 47 for excitation pulse polarities rather than for the amplitude of the representative coefficient. Like in FIG. 3, the harmonics quantizer 35 searches one of the polarity code vectors p[k](q) that minimizes the gain code vector distortion D[k] given by:

$$D[k] = \sum_{q=1}^{K} [X(m(q)) - \beta p[k](q)]^2. \tag{7}$$

As in FIG. 7, the device output signal comprises the pitch interval and indexes indicative of the excitation pulse positions of the selected pulse sequence, the pulse or harmonics code vector, the residue code vectors, and the gain code vectors.

Figure 11:
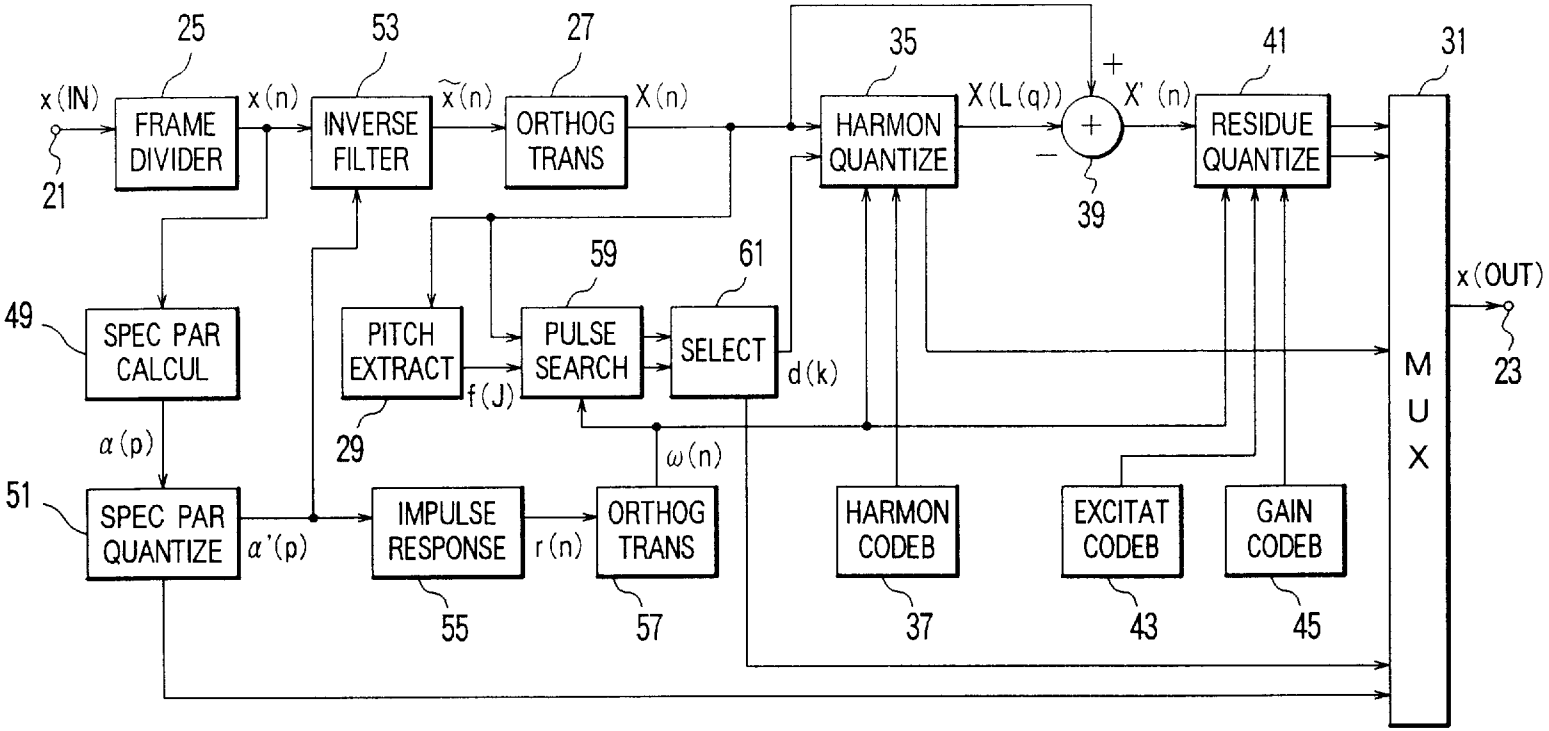
FIG. 11 is a block diagram of a signal encoding device according to an eleventh embodiment of this invention.

Referring now to FIG. 11, attention will be directed to a signal encoding device according to an eleventh embodiment of this invention. This signal encoding device is similar to a combination of those described with reference to FIG. 7 and to FIG. 4.

More in detail, the signal encoding device comprises as in FIG. 4 the spectral parameter calculator 49 and the spectral parameter quantizer 51, which collectively serve as a spectral parameter quantizing circuit (49, 51) for quantizing spectral parameters of the successive frames x(n) supplied collectively as the device input signal x(IN). The spectral parameter quantizing circuit (49, 51) produces by quantization and dequantization the dequantized LPC's α '(p) as linear prediction coefficients and supplies the multiplexer 31 with an index indicative of the quantized parameters.

The inverse filter 53 delivers in response to the linear prediction coefficients the inverse filtered signal to the first orthogonal transform circuit 27 which produces the primary coefficients of the first orthogonal transform as in FIG. 1. On the other hand, the impulse response calculating circuit 55 uses the linear prediction coefficients in producing the impulse response signal representative of the auditorily or perceptually weighted impulse responses as in FIG. 4. Responsive to the impulse response signal, the second orthogonal transform circuit 57 produces the secondary coefficients of the second orthogonal transform. In the meanwhile, the pitch extractor 29 extracts as in FIG. 1 the pitch frequency f(J) from the primary coefficients supplied thereto as the device input signal.

In FIG. 11, the pulse searching circuit 59 is supplied with the primary and the secondary coefficients and the pitch frequency. The pulse searching circuit 59 repeatedly searches in the primary coefficients, by using the secondary coefficients as the weighting coefficients ω (n) and additionally using the pitch frequency in determining the excitation pulse positions, the first sequence of the primary excitation pulses. Furthermore, the pulse searching circuit 59 repeatedly searches in the primary coefficients, by using the weighting coefficients, the second sequence of secondary excitation pulses without using the pitch frequency. The first and the second sequences are determined to minimize primary and secondary weighted excitation pulse distortions D[pr•] and D[sec•] given by:

$$D[pr\omega] = \sum_{n=0}^{M-1} \omega(n) \left[ X(n) - \sum_{k=1}^{K} a[pr](k) \times \delta(n - m[pr](k) - L(q)) \right]^2,$$

and $$D[\sec\omega] = \sum_{n=0}^{M-1} \omega(n) \left[ X(n) - \sum_{k=1}^{K} a[\sec](k) \times \delta(n - m[\sec](k)) \right]^2.$$

The pulse selector 61 selects one of the first and the second pulse sequences as the selected sequence d(k) that provides a smaller one of the primary and the secondary weighted excitation pulse distortions, namely, that better represents the first orthogonal transform than the other of the first and the second sequences. The pulse selector 61 thereby delivers the excitation pulses of the selected sequence as the harmonics coefficients to the harmonics quantizer 35 and supplies the multiplexer 31 with an index indicative of the excitation pulse positions of the primary and the secondary excitation pulses or of the selected ones of the primary and the secondary excitation pulses.

Using the secondary coefficients as the weighting coefficients, the harmonics quantizer 35 refers to the pulse or harmonics amplitude codebook 37 to quantize the excitation pulse amplitudes c[hk](q) of the selected sequence and to deliver the dequantized representative quantizer to the subtracter 39 by minimizing a weighted harmonics distortion D[kω] given by:

$$D[k\omega] = \sum_{q=1}^{K} \omega(m(q)) [X(m(q)) - \beta c[hk](q)]^2.$$

Like in FIG. 4, the residue quantizer 41 uses the secondary coefficients as the weighting coefficients to produce the residue code vectors and the gain code vectors. The device output signal comprises indexes indicative of the quantized parameters, the pulse positions of the primary and the secondary excitation pulses, the pulse or harmonics code vector, the residue code vectors, and the gain code vectors.

Figure 12:
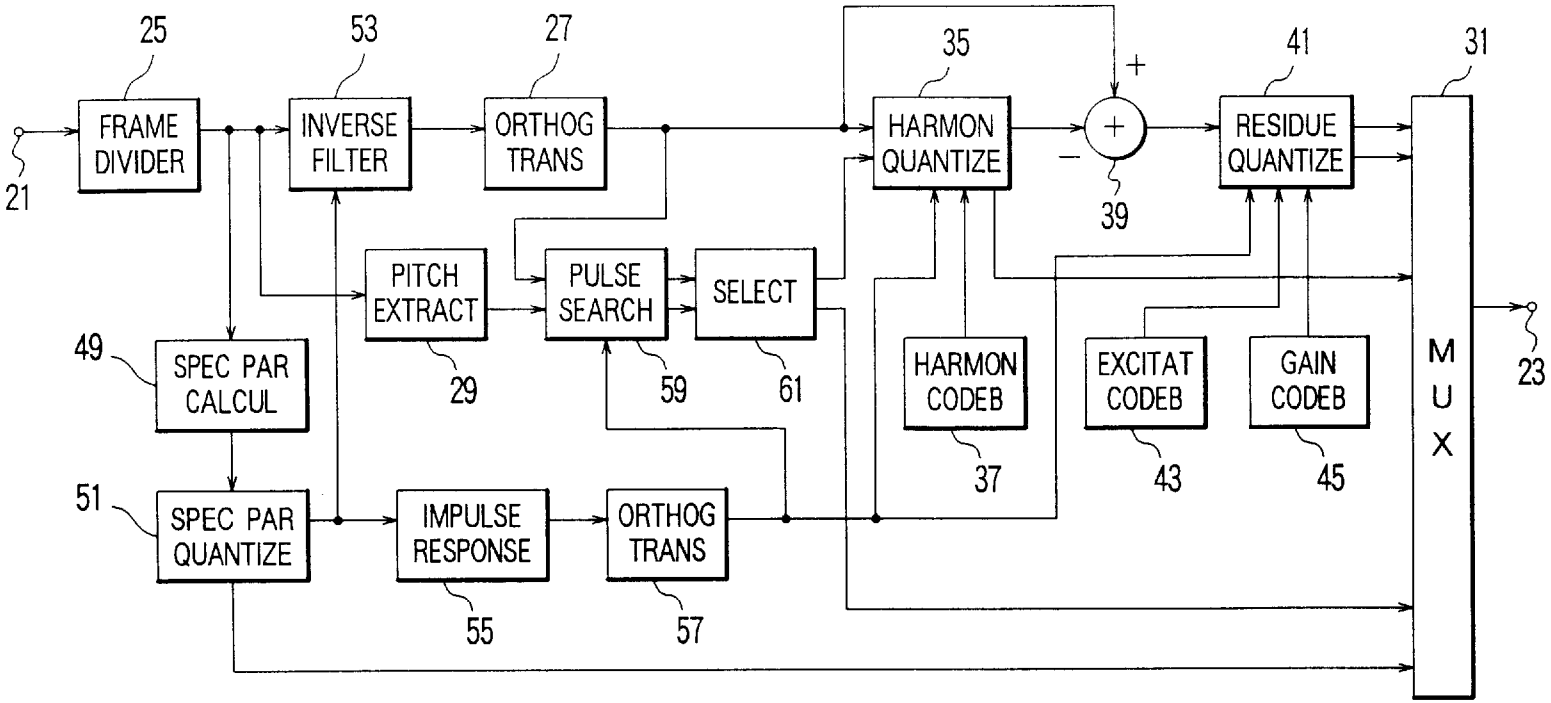
FIG. 12 is a block diagram of a signal encoding device according to a twelfth embodiment of this invention.

Referring to FIG. 12, the description will proceed to a signal encoding device according to a twelfth embodiment of this invention. In this signal encoding device, the pitch extractor 29 is supplied from the frame divider 25 with the successive frames of the device input signal like in FIG. 2, 5, 8, or 9. In other respects, the signal encoding device is not different from that illustrated with reference to FIG. 11.

Figure 13:
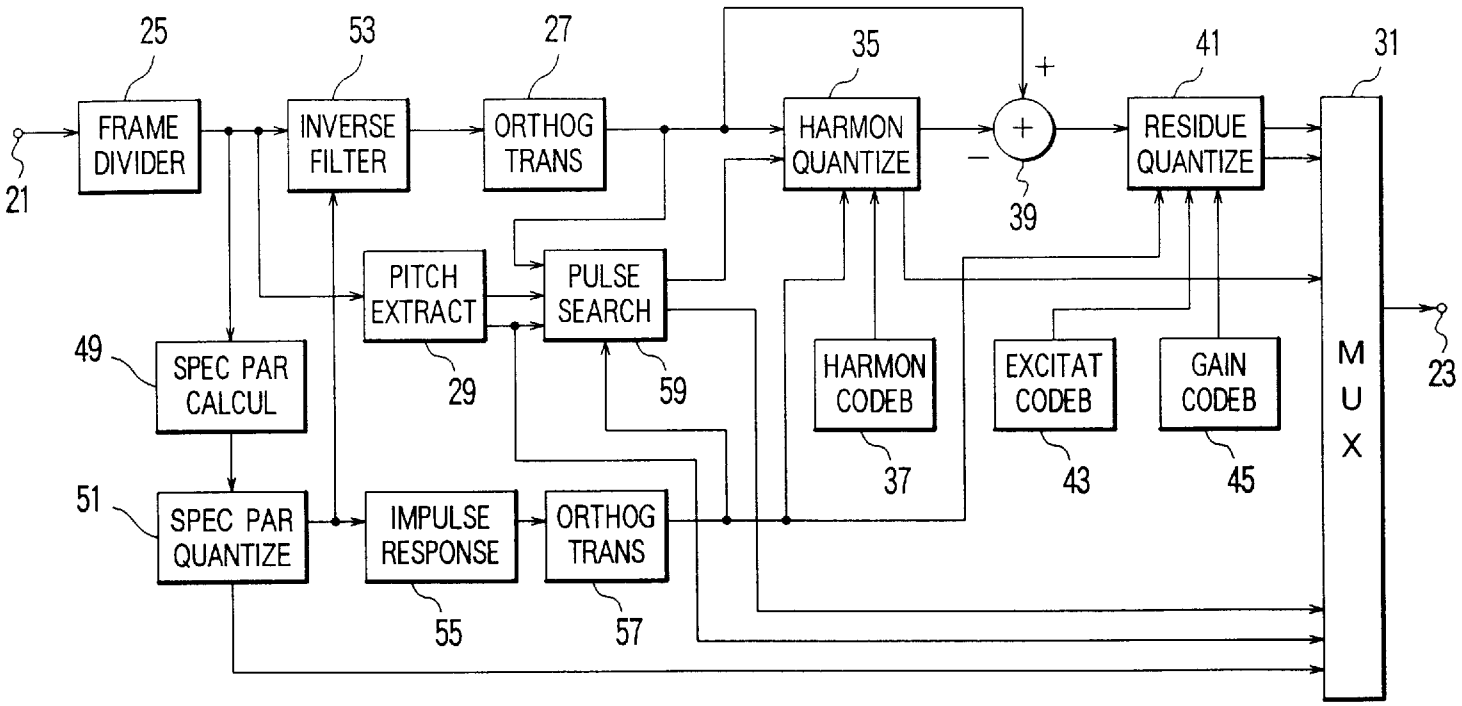
FIG. 13 is a block diagram of a signal encoding device according to a thirteenth embodiment of this invention.

Referring to FIG. 13, the description will proceed further to a signal encoding device according to a thirteenth embodiment of this invention. As regards the pitch extractor 29 and the pulse searching circuit 59 or (59, 61), the signal encoding device has a structure similar to that of FIG. 9.

In the example being illustrated, the pulse searching circuit 59 is supplied from the first orthogonal transform circuit 27 with the primary coefficients X(n) and from the pitch extractor 29 with the pitch frequency f(J) and the discrimination information D(n) and is controlled by the secondary coefficients supplied from the second orthogonal transform circuit 57 as the weighting coefficients ω (n). It will first be surmised that the discrimination information indicates the voiced frames. In this event, the pulse searching circuit 59 repeatedly searches in the primary coefficients the voiced frame sequence of primary excitation pulses by using the pitch frequency to minimize a primary weighted excitation pulse distribution D[prω] of an equation which is similar to Equation (5) and is given by:

$$D[pr\omega] = \sum_{n=0}^{M-1} \omega(n) \left[ X(n) - \sum_{k=1}^{K} a[pr](k) \times \delta(n - m[pr](k) - L(q)) \right]^2.$$

It will next be surmised that the discrimination information indicates the unvoiced frames. The pulse searching circuit 59 repeatedly searches in the primary coefficients the unvoiced frame sequence of secondary excitation pulses without using the pitch frequency to minimize a secondary weighted excitation pulse distribution D[secω] of another equation which is similar to Equation (6) and is given by:

$$D[\sec\omega] = \sum_{n=0}^{M-1} \omega(n) \left[ X(n) - \sum_{k=1}^{K} a[\sec](k) \times \delta(n - m[\sec](k)) \right]^2.$$

In other respects, the signal encoding device is operable in the manner described in conjunction with FIG. 12.

Figure 14:
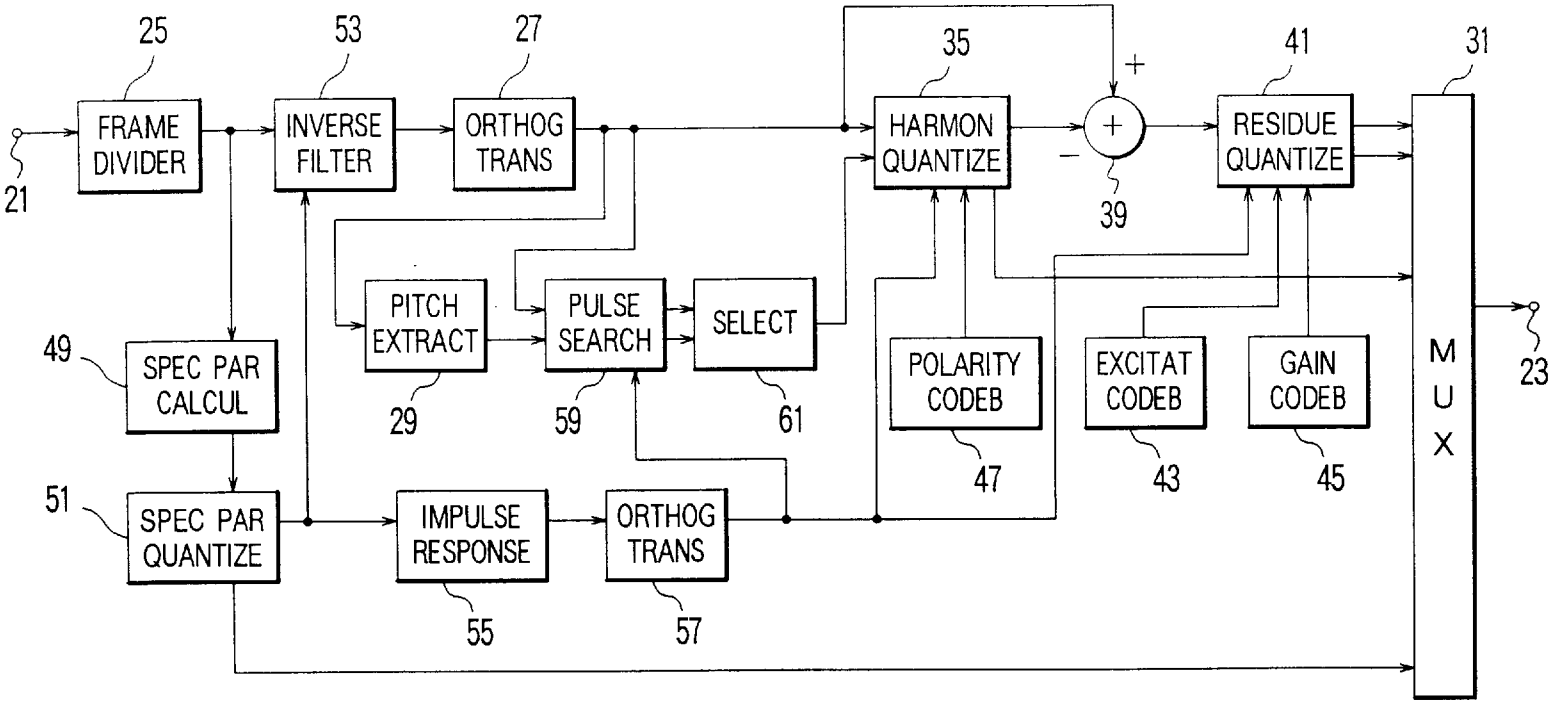
FIG. 14 is a block diagram of a signal encoding device according to a fourteenth embodiment of this invention.

Referring to FIG. 14, the description will proceed finally to a signal encoding device according to a fourteenth embodiment of this invention. Like in FIG. 3, 6, or 10, the harmonics quantizer 35 refers to the pulse polarity codebook 47 to quantize polarities of the excitation pulses of the selected sequence. In other respects, the signal encoding device is similar to that illustrated with reference to FIG. 12.

On referring to the pulse polarity codebook 47, the secondary coefficients of the secondary orthogonal transform circuit 57 are used as the weighting coefficients. Minimization is for a weighted gain code vector distortion D[kω] given by an equation which corresponds to Equation (7) and is as follows.

$$D[k\omega] = \sum_{q=1}^{K} \omega(m(q)) \, [X(m(q)) - \beta p[lk](q)]^2.$$

Reviewing FIGS. 1 to 14, it is understood in this invention that harmonics frequency or frequencies are first preliminarily estimated in the primary or input orthogonal transform coefficients derived from the device input signal either directly or through spectral parameter quantization. Secondly, a harmonics component of the primary or the input orthogonal transform coefficient is quantized into a harmonics code vector. In the meantime, a residue component is calculated by removing the harmonics component from the primary or the input orthogonal coefficients and is quantized into residue code vectors and gain code vectors. It is thereby rendered possible to attain an excellent quantization quality.

Furthermore, the harmonics and the residue components are separately quantized. This makes it feasible to quantize each component with a small number of bits and therefore to quantize the device input signal at a low bit rate.

While this invention has thus far been described in specific conjunction with more than ten preferred embodiments thereof, it will now readily be possible to put this invention into practice in various other manners. For example, it is possible to extract the pitch frequency from each of successive segments, each of which has less number of signal samples than each frame used in calculating the orthogonal transform coefficients. This reduces an amount of calculation.

The orthogonal transform may be other known transform, such as the MDCT (modified DCT). It has been presumed in the foregoing that a predetermined number of quantization bits are used in harmonics quantization, apulse quantization, and residue quantization. It is, however, possible, when the successive segments are used, to assign the quantization bits of different numbers to the segments adaptively in compliance with powers which are had in a frequency axis by the signal to be quantized. For instance, this adaptive assignment may depend on relative power ratios as described in the Tribolet et al paper referred to hereinabove. Use of multistage quantization in the residue quantization can further reduce the amount of calculation.

What is claimed is:

1. A signal encoding method comprising the steps of:

calculating an orthogonal transform of an input signal to produce orthogonal transform coefficients of said orthogonal transform;

extracting a pitch frequency from said input signal;

estimating harmonics locations on said orthogonal transform coefficients by using said pitch frequency to produce harmonics coefficients at said harmonics locations;

quantizing said harmonics coefficients jointly as a representative coefficient into a harmonics code vector representative of a quantized harmonics coefficient; and quantizing residue coefficients into residue code vectors and gain code vectors, said residue coefficients being given by removing said quantized representative coefficient from said orthogonal transform coefficients;

whereby said input signal is encoded into an output signal comprising a pitch interval of said pitch frequency and indexes indicative of said harmonics code vector, said residue code vectors, and said gain code vectors.

2. A signal encoding method comprising the steps of:

calculating an orthogonal transform of an input signal to produce orthogonal transform coefficients of said orthogonal transform;

extracting a pitch frequency from said input signal;

searching in said input signal a first pulse sequence of primary excitation pulses by repeatedly using said pitch frequency and a second pulse sequence of secondary excitation pulses without using said pitch frequency;

quantizing the excitation pulses of a selected one of said first and said second pulse sequences jointly as a representative pulse into a pulse code vector representative of a quantized representative coefficient; and quantizing residue coefficients into residue code vectors and gain code vectors, said residue coefficients being given by removing said quantized representative coefficient from said orthogonal transform coefficients;

whereby said input signal is encoded into an output signal comprising a pitch interval of said pitch frequency and indexes indicative of pulse positions of said primary and said secondary excitation pulses, said pulse code vector, said residue code vectors, and said gain code vectors.

3. A signal encoding device comprising:

an orthogonal transform circuit responsive to a device input signal for calculating an orthogonal transform of said device input signal to produce orthogonal transform coefficients of said orthogonal transform;

a pitch extractor for extracting a pitch frequency from said device input signal;

a harmonics estimating circuit responsive to said pitch frequency for estimating harmonics locations in said orthogonal transform coefficients to produce harmonics coefficients at said harmonics locations;

a harmonics quantizer for quantizing said harmonics coefficients jointly as a representative coefficient into a harmonics code vector representative of a quantized representative coefficient; and a residue quantizer for quantizing residue coefficients into residue code vectors and gain code vectors, said residue coefficients being given by removing said quantized representative coefficient from said orthogonal transform coefficients;

whereby said device input signal is encoded into a device output signal comprising a pitch interval of said pitch frequency and indexes indicative of said harmonics code vector, said residue code vectors, and said gain code vectors.

4. A signal encoding device as claimed in claim 3, wherein said harmonics quantizer quantizes amplitudes of said harmonics coefficients.

5. A signal encoding device as claimed in claim 3, wherein said harmonics quantizer quantizes polarities of said harmonics coefficients.

6. A signal encoding device as claimed in claim 3, wherein said pitch extractor extracts said pitch frequency from each frame of said device input signal.

7. A signal encoding device as claimed in claim 3, wherein said pitch extractor extracts said pitch frequency from orthogonal transform coefficients produced from each frame of said device input signal.

8. A signal encoding device comprising:

a spectral parameter quantizer for quantizing spectral parameters of a device input signal into quantized parameters and for converting said quantized parameters into linear prediction coefficients;

an inverse filter responsive to said linear prediction coefficients for producing an inverse filtered signal;

a first orthogonal transform circuit responsive to said inverse filtered signal for calculating a first orthogonal transform of said device input signal to produce primary coefficients of said first orthogonal transform;

a pitch extractor for extracting a pitch frequency from said device input signal;

a harmonics estimating circuit responsive to said pitch frequency for estimating harmonics locations on said primary coefficients to produce harmonics coefficients at said harmonics locations;

an impulse response calculating circuit for calculating auditorily weighted impulse responses of said linear prediction coefficients to produce an impulse response signal representative of said auditorily weighted impulse responses;

a second orthogonal transform circuit responsive to said impulse response signal for calculating a second orthogonal transform of said impulse response signal to produce secondary coefficients of said second orthogonal transform;

a harmonics quantizer for quantizing said harmonics coefficients jointly as a representative coefficient by using said secondary coefficients into a harmonics code vector representative of a quantized representative coefficient; and a residue quantizer for quantizing residue coefficients into residue code vectors and gain code vectors, said residue coefficients being given by removing said quantized representative coefficient from said primary coefficients;

whereby said device input signal is encoded into a device output signal comprising indexes indicative of said quantized parameters, said harmonics code vector, said residue code vectors, and said gain code vectors.

9. A signal encoding device as claimed in claim 8, wherein said harmonics quantizer quantizes amplitudes of said primary coefficients.

10. A signal encoding device as claimed in claim 8, wherein said harmonics quantizer quantizes polarities of said primary coefficients.

11. A signal encoding device as claimed in claim 8, wherein said pitch extractor extracts said pitch frequency from each frame of said device input signal.

12. A signal encoding device as claimed in claim 8, wherein said pitch extractor extracts said pitch frequency from the primary coefficients produced from each frame of said device input signal.

13. A signal encoding device comprising:

an orthogonal transform circuit responsive to a device input signal for calculating an input orthogonal transform of said device input signal to produce orthogonal transform coefficients of said orthogonal transform;

a pitch extractor for extracting a pitch frequency from said device input signal;

a pulse searching circuit for repeatedly searching in said device input signal a first pulse sequence of primary excitation pulses by using said pitch frequency and a second pulse sequence of secondary excitation pulses without using said pitch frequency;

a selector for selecting one of said first and said second pulse sequences as a selected sequence of selected excitation pulses that better represents said orthogonal transform coefficients than the other of said first and said second pulse sequences;

a harmonics quantizer for quantizing said selected excitation pulses jointly as a representative pulse into a pulse code vector representative of a quantized representative coefficient; and a residue quantizer for quantizing residue coefficients into residue code vectors and gain code vectors, said residue coefficients being given by removing said quantized representative coefficient from said orthogonal transform coefficients;

whereby said device input signal is encoded into a device output signal comprising a pitch interval of said pitch frequency and indexes indicative of pulse positions of said selected excitation pulses, said pulse code vector, said residue code vectors, and said gain code vectors.

14. A signal encoding device as claimed in claim 13, wherein said harmonics quantizer quantizes amplitudes of said selected excitation pulses.

15. A signal encoding device as claimed in claim 13, wherein said harmonics quantizer quantizes polarities of said selected excitation pulses.

16. A signal encoding device as claimed in claim 13, wherein said pitch extractor extracts said pitch frequency from each frame of said device input signal.

17. A signal encoding device as claimed in claim 13, wherein said pitch extractor extracts said pitch frequency from the input orthogonal transform coefficients produced from each frame of said device input signal.

18. A signal encoding device comprising:

an orthogonal transform circuit responsive to a device input signal for calculating an input orthogonal transform of said device input signal to produce input orthogonal transform coefficients of said input orthogonal transform;

a pitch extracting circuit for extracting a pitch frequency from each of successive frames of said device input signal and for discriminating said successive frames between a voiced and an unvoiced frame;

a pulse searching circuit for repeatedly searching in said voiced frame a voiced frame pulse sequence of primary excitation pulses by using said pitch frequency and in said unvoiced frame an unvoiced frame pulse sequence of secondary excitation pulses without using said pitch frequency;

a harmonics quantizer for quantizing said primary excitation pulses jointly as a representative pulse into a pulse code vector representative of a quantized representative coefficient; and a residue quantizer for quantizing residue coefficients into residue code vectors and gain code vectors, said residue coefficients being given by removing said quantized representative coefficient from said orthogonal transform coefficients;

whereby said device input signal is encoded into a device output signal comprising a pitch internal of said pitch frequency, information separately indicative of said voiced and said unvoiced frames, and indexes indicative of pulse positions of said primary and said secondary excitation pulses, said pulse code vector, said residue code vectors, and said gain code vectors.

19. A signal encoding device comprising:

a spectral parameter quantizing circuit for quantizing spectral parameters of a device input signal into quantized parameters and for converting said quantized parameters into linear prediction coefficients;

an inverse filter responsive to said linear prediction coefficients for producing an inverse filtered signal;

a first orthogonal transform circuit responsive to said inverse filtered signal for calculating a first orthogonal transform of said device input signal to produce primary coefficients of said first orthogonal transform;

a pitch extractor for extracting a pitch frequency from said device input signal;

an impulse response calculating circuit for calculating auditorily weighted impulse responses of said linear prediction coefficients to produce an impulse response signal representative of said auditorily weighted impulse responses;

a second orthogonal transform circuit responsive to said impulse response signal for calculating a second orthogonal transform of said impulse response signal to produce secondary coefficients of said second orthogonal transform;

a pulse searching circuit for repeatedly searching in said device input signal by using said secondary coefficients a first pulse sequence of primary excitation pulses by using said pitch frequency and a second pulse sequence of secondary excitation pulses without using said pitch frequency;

a selector for selecting one of said first and said second pulse sequences as a selected sequence of selected excitation pulses that better represents said first orthogonal transform than the other of said first and said second pulse sequences;

a harmonics quantizer for quantizing by using said second coefficients said selected excitation pulses jointly as a representative pulse into a pulse code vector representative of a quantized representative coefficient; and a residue quantizer for quantizing by using said secondary coefficients residue coefficients into residue code vectors and gain code vectors, said residue coefficients being given by removing said quantized representative coefficient from said primary coefficients;

whereby said device input signal is encoded into a device output signal comprising indexes indicative of said quantized parameters, pulse positions of said primary and said secondary excitation pulses, said pulse code vector, said residue code vectors, said gain code vectors.

20. A signal encoding device as claimed in claim 19, wherein said harmonics quantizer quantizes amplitudes of said selected excitation pulses.

21. A signal encoding device as claimed in claim 19, wherein said harmonics quantizer quantizes polarities of said selected excitation pulses.

22. A signal encoding device as claimed in claim 19, wherein said pitch extractor extracts said pitch frequency from each frame of said device input signal.

23. A signal encoding device as claimed in claim 19, wherein said pitch extractor extracts said pitch frequency from the primary coefficients produced from each frame of said device input signal.

24. A signal encoding device comprising:

a spectral parameter quantizing circuit for quantizing spectral parameters of an input signal into quantized parameters and for converting said quantized parameters into linear prediction coefficients;

an inverse filter responsive to said linear prediction coefficients for producing an inverse filtered signal;

a first orthogonal transform circuit responsive to said inverse filtered signal for calculating a first orthogonal transform of said device input signal to produce primary coefficients of said first orthogonal transform;

a pitch extracting circuit for extracting a pitch frequency from each of successive frames of said device input signal and for discriminating said successive frames between a voiced and an unvoiced frame;

an impulse response calculating circuit for calculating auditorily weighted impulse responses of said linear prediction coefficients to produce an impulse response signal representative of said auditorily weighted impulse responses;

a second orthogonal transform circuit responsive to said impulse response signal for calculating a second orthogonal transform of said impulse response signal to produce secondary coefficients of said second orthogonal transform;

a pulse searching circuit for repeatedly searching by using said secondary coefficients in said voiced frame a voiced frame pulse sequence of primary excitation pulses by using said pitch frequency and in said unvoiced frame and unvoiced frame pulse sequence of secondary excitation pulses without using said pitch frequency;

a harmonics quantizer for quantizing by using said secondary coefficients said primary excitation pulses jointly as a representative pulse into a pulse code vector representative of a quantized representative coefficient; and a residue quantizer for quantizing by using said secondary coefficients residue coefficients into residue code vectors and gain code vectors, said residue coefficients being given by removing said quantized representative coefficient from said primary coefficients;

whereby said device input signal is encoded into a device output signal comprising information separately indicative of said voiced and said unvoiced frames and indexes indicative of said quantized parameters, pulse positions of said primary and said secondary excitation pulses, said pulse code vector, said residue code vectors, and said gain code vectors.

* * * * *